US005523125A

United States Patent [19]

Kennedy et al.

[11] Patent Number: 5,523,125

[45] Date of Patent: Jun. 4, 1996

[54] LASER ENGRAVING AND COATING PROCESS FOR FORMING INDICIA ON ARTICLES

[75] Inventors: Thomas J. Kennedy, Wilbraham; Mark L. Binette, Ludlow; Michael Konieczny, Northampton, all of Mass.

[73] Assignee: Lisco, Inc., Tampa, Fla.

[21] Appl. No.: 506,671

[22] Filed: Jul. 25, 1995

Related U.S. Application Data

[63] Continuation-in-part of Ser. No. 112,298, Aug. 27, 1993, abandoned.

[51] Int. Cl.[6] ..... B05D 3/00

[52] U.S. Cl. ..... 427/555; 427/155; 427/226; 427/228; 427/259; 427/264; 427/265; 427/270; 427/272; 427/276; 427/282; 427/286; 427/289; 427/385.5; 427/407.1; 427/596

[58] Field of Search ..... 427/155, 226, 427/228, 259, 264, 265, 270, 272, 276, 282, 286, 289, 385.5, 407.1, 555, 596

*Primary Examiner*—Bernard Pianalto

[57] ABSTRACT

A process for providing indicia to the surface of an article. The process comprising the steps of: providing an article having material initially forming at least a portion of its exterior surface; coating at least part of the material whereat indicia is to be provided to thereby form a film; contacting, with radiation from a radiation beam, indicia areas of the film intended to be provided with indicia, the radiation thereby removing the film and modifying the surface of the material of the indicia areas and also forming a mask in the non-indicia areas of the film; applying an ink to the indicia areas thereby forming the indicia on the surface; drying the ink; and removing the film.

11 Claims, 4 Drawing Sheets

LASER ENGRAVING AND COATING PROCESS FOR FORMING INDICIA ON ARTICLES

RELATED APPLICATION

This application is a continuation-in-part application of U.S. patent application Ser. No. 08/112,298, filed Aug. 27, 1993, abandoned.

BACKGROUND OF THE INVENTION

1. Field of the Invention

This invention relates to laser engraving and coating process for forming indicia on articles and, more particularly, to a process utilizing a mask and laser for marking synthetic game balls and the like.

2. Description of the Background Art

Most sports today utilize a ball. Balls can be made of a wide variety of materials and shapes but are mostly round. Such balls may be large or small, hard or soft, resilient or not. One common characteristic of most such game balls today, regardless of their size, shape, material, etc., is the inclusion of indicia on an exposed surface. Such indicia may take the form of a trademark, trade name, trade dress, logo or the like, to indicate the source of origin of the ball. Such indicia may also include an endorsement as from a famous player of the game who has used such type of a ball. Such indicia may also be in the form of writing to indicate instructions for the use or care of the ball. Such indica may also be used simply for decoration. Regardless of the nature or purpose of the indicia, its value, and the value of the ball, may be diminished if the indicia is not provided on the surface of the ball in a precise and accurate manner.

Typical of balls in the prior art to which such indicia may be applied include U.S. Pat. Nos. 3,119,618 to Molitor; 4,093,219 to Piraud; 4,333,648 to Aoyama; and 4,462,590 to Mitchell. Another typical ball is disclosed in parent U.S. patent application Ser. No. 08/010,956 to Walker et al and assigned to the assignee of the instant invention. Various techniques for providing indicia or otherwise selectively depositing material on external surfaces, as for example, surfaces of game balls, include U.S. Pat. Nos. 4,578,281 to Ebiwasa; 4,847,181 to Shimokawa; 4,865,873 to Cole; 4,933,205 to Duley; 5,075,195 to Bäbler; 5,085,697 to Kimura; 5,151,386 to Bottari; 5,185,055 to Temple; and 5,185,186 to Kawakami.

Despite the large number of prior art patents to game balls and marking techniques, no prior art disclosure deals with the capability of functioning with the benefit of the present invention to provide desired indicia accurately, quickly and economically as does the present invention.

Accordingly, it is an object of this invention to provide a process for providing indicia to the surface of an article. The process comprising the steps of: providing an article having material initially forming at least a portion of its exterior surface; coating at least part of the material whereat indicia is to be provided to thereby form a film; contacting, with radiation from a radiation beam, indicia areas of the film intended to be provided with indicia, the radiation thereby removing the film and modifying the surface of the material of the indicia areas and also forming a mask in the non-indicia areas of the film; applying an ink to the indicia areas thereby forming the indicia on the surface; drying the ink; and removing the film.

A further object of the present invention is to create indicia on the exterior surfaces of game balls.

It is a further object of the present invention to utilize lasers for the precise marking of indicia onto game balls or other articles.

It is a further object of the present invention to mark game balls with indelible ink to create markings in an accurate, quick and economical manner.

These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purposes of summarizing the invention, the invention may be incorporated into a process for providing indicia to the surface of a game ball, the process comprising the steps of providing a process for providing indicia to the surface of a game ball, the process comprising the steps of: providing a game ball having a synthetic material initially forming at least a portion of its exterior surface; coating, with a solution of polyvinyl alcohol and a plasticizer and water, at least part of the synthetic material whereat indicia is to be provided, to thereby form a hardened film; contacting, with a laser beam, indicia areas of the hardened film and synthetic material or leather intended to be provided with indicia, the laser beam thereby ablatively removing the film and modifying the synthetic material or leather in the entire indicia areas and also forming a mask in the non-indicia areas of the film; applying an indelible ink to the indicia areas for constituting the indicia on the surface of the game ball; drying the ink; removing the film by peeling; and washing with warm water any unpeeled portions of the film.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several Figures.

DETAILED DESCRIPTION OF THE PREFERRED EMBODIMENT

Figure 1:
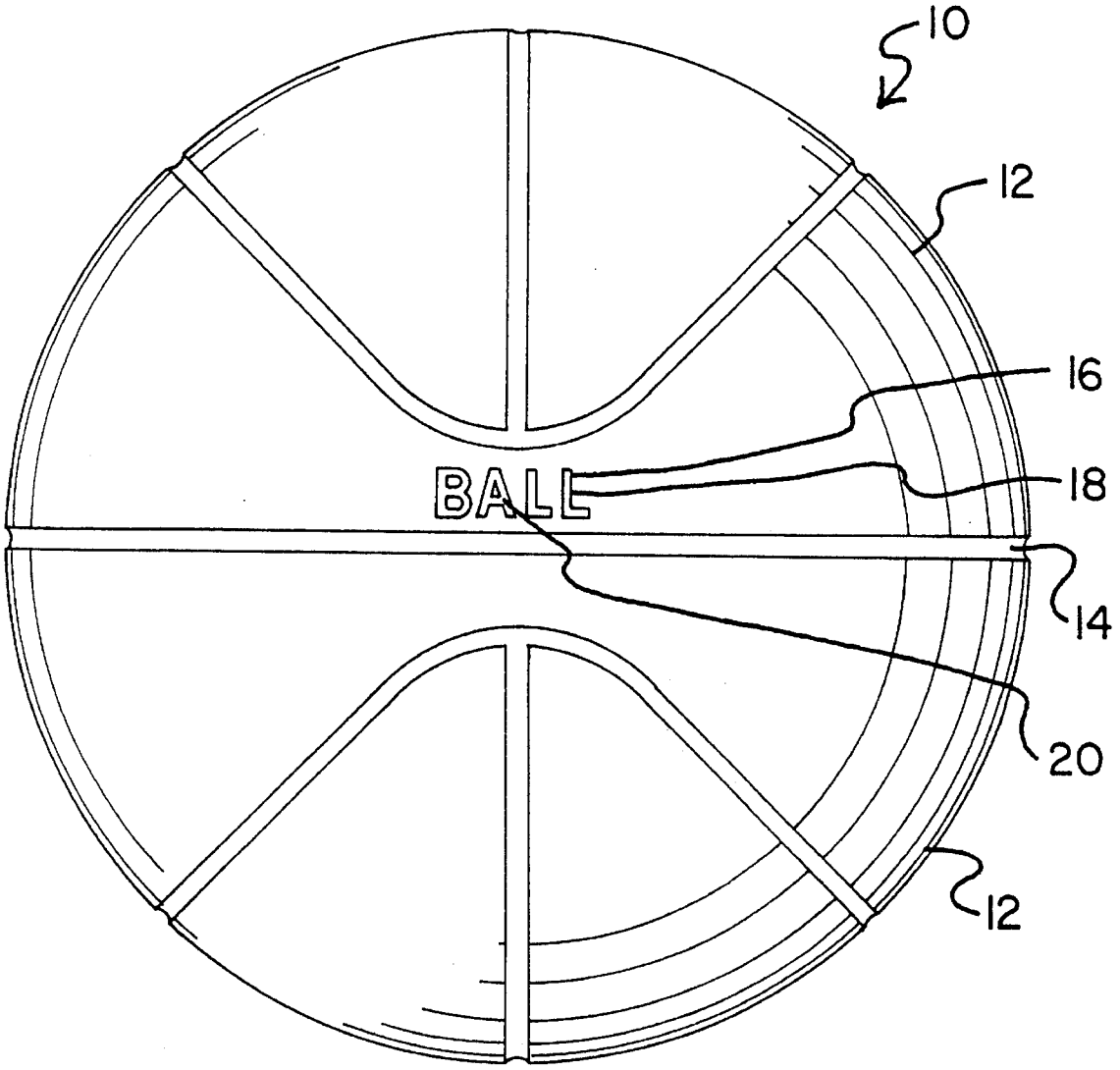
FIG. 1 is a plan view of a basketball provided with indicia created by the method of the present invention.

With reference now to the drawings, and in particular to FIG. 1 thereof, is a basketball 10 provided with indicia formed in accordance with the method or process of the present invention.

Figure 2:
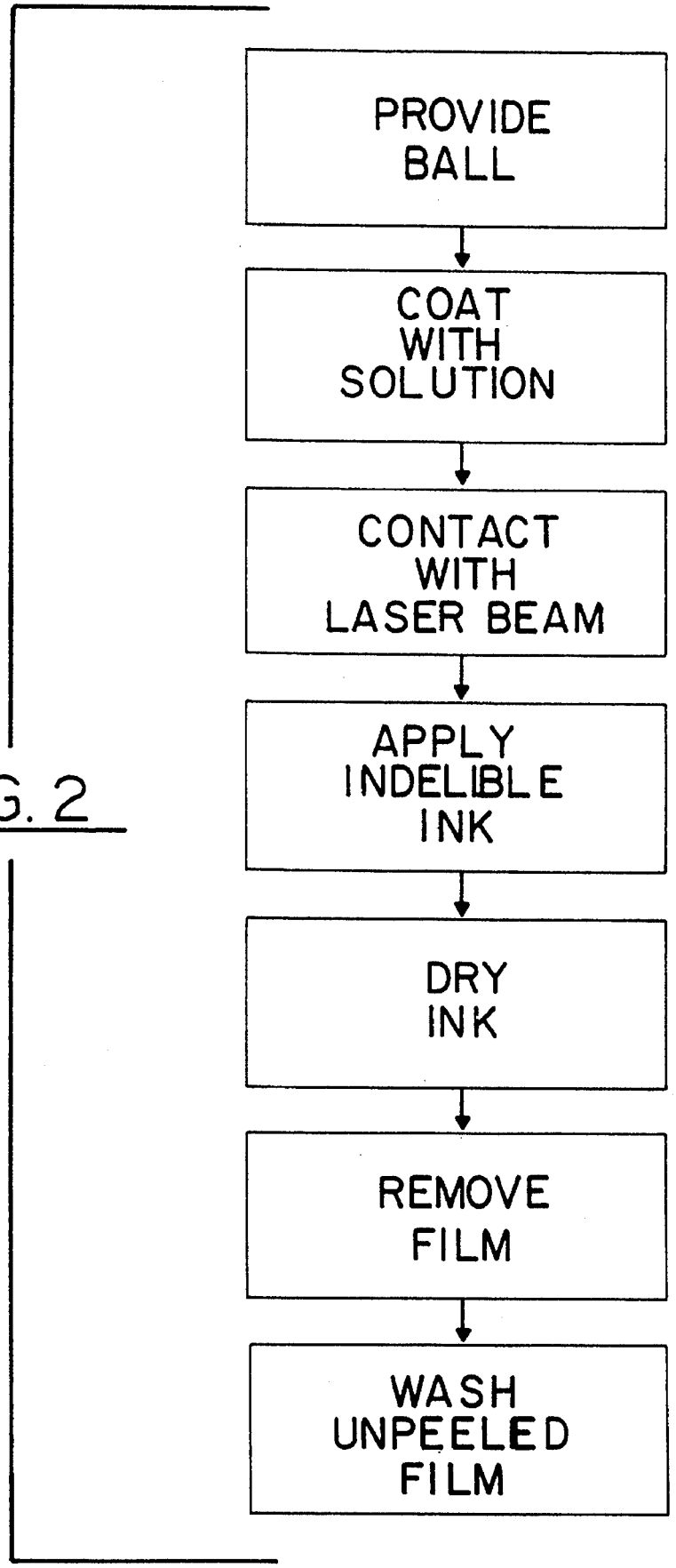
FIG. 2 is a flow diagram of the steps utilized to form the indicia on the surface of the ball of FIG. 1.

From an overview standpoint, a basketball 10 is constructed in accordance with the principles of the present invention and can readily be understood with reference to the showings of FIG. 1, 2 and 3. Such basketball 10 is made up of four major component: (1) an interior balloon or bladder, (2) an intermediate layer of monofilament strands wrapped around the bladder, (3) a carcass 20 comprised of a pair of molded hemispheres secured over the intermediate layer with exterior ribs or channels defining spaces between the channels and (4) insert panels of polyurethane secured in the spaces by an adhesive.

More specifically, the interior layer is formed spherically and is adapted to be filled with air to constitute a bladder for the basketball 10. The interior bladder, when properly inflated with air, is adapted to provide the primary resilience to the finished basketball. The preferred material for the bladder is principally synthetic butyl rubber as is conventional for high quality basketballs but includes about 15 percent natural rubber with about 85percent synthetic butyl rubber. The bladder has an exterior diameter of between about 230 and 240 millimeters, an interior thickness of about 0.85 millimeters and weighs between about 140 and 150 grams. The conventional basketball weighs between about 160 to 180 grams.

Next exterior to the interior layer or bladder is an intermediate layer. The intermediate layer is formed of wound monofilament polymeric strands, preferably of Nylon 66 or Nylon/Polyester mix. Each strand has a diameter of about 140 denur, 6.8 filaments. About 2,100 meters of such monofilament strands is wound around the bladder to form a thin layer, between about 2 to 4 strands in total thickness, or between about 0.3 to 0.7 millimeters. The strands are coated with an adhesive, preferably a solvent based rubber cement, to ensure retention of the strands on the bladder as is conventional. The exterior diameter of the wound bladder is thus between about 230.3 and 240.7 millimeters. The intermediate layer adds dimensional stability to the bladder and ball, restrain outward expansion when inflated and also reduces outward pressure on the exterior carcass.

The exterior most layer of the basketball is a molded rubber carcass. The carcass is preferably formed of two hemispheres separated at an equator line which, when overlaid to cover the intermediate layer, will create the exterior of the ball. The exterior carcass has a thickness of about 1.8 to 2.0 millimeters over the majority of the surface, as is conventional. The preferred material for the hemispheres is natural rubber in basketball of highest quality. Molded into the hemispheres on the exterior surface thereof are exteriorly extending ribs or channels 12 in a pattern corresponding to the black lines normally visible when viewing a basketball. The ribs 12 extend outwardly from the central portion of the carcass to a distance of about 1.8 millimeters or slightly less due to skiving of the panels. The approximate thickness of the insert panels 14 to be attached to the carcass is about 1.8 millimeters. As a result, the exterior diameter of the panels and, consequently, the finished ball is between about 9.46 and 9.55 inches, the regulation size for basketballs. This is a circumference of between about 29.5 and 30.0 inches. The molding of the carcass onto the intermediate layer forms the channels and causes the carcass material to flow into and around the strands of the intermediate layer for a secure mechanical bond.

The cover of the basketball is formed of panels 14. Such panels are first cut to a shape to fit inside the spaces 16 between the ribs 12 as is conventional. An adhesive, preferably a contact cement such as styrene butadiene, holds the panels in place. Other suitable cements include Acrylonitrile-Butadiene-Styrene (ABS), a plastic, or a two-part urethane. An aperture is formed in one panel and extends through the layers therebeneath for passage of a valve, formed integrally with the bladder, for inflating and deflating the basketball, also as is conventional.

The polyurethane layer includes a plurality of monofilament polymeric fibers of Nylon, a polyamide, or a Polyester compressed together in an array to form a mate with polyurethane material located above, below, and throughout the spaces between the fibers. Such fibers have a diameter of about 1.0 micron. This is a size significantly smaller than the fibers used in prior applications to form synthetic panels. On the exterior surface of the panels, a grain-like pattern of raised portions in an irregular pebble-like pattern, is formed to simulate leather. The exterior surface is also then preferably painted to simulate grain leather. It is this exterior surface which constitutes the recipient surface for receiving ink in creating the indicia on the ball surface.

The fabrication for the insert material includes an impregnation of fibers with polyurethane in dimethyl formamide (DMF). The material subsequently undergoes an extraction process to give the material a soft feel. The top coat on the material is also a polyurethane, preferably the same material that is used to impregnate the fibers. Also, the diameter or denur (size) of the fibers is smaller than usual. More specifically, a solution of polyurethane elastomer in DMF, with sorbitan monostrearate and strearyl alcohol as additives, is forced into the nonwoven fabric of the mat fibers and the solution impregnation down into the inside and the nonwoven fabric. In addition, a polyurethane solution with these additives in DMF is coated on top of the base material to form a polyurethane coating layer and is put into an aqueous solution of (DMF). This coagulates the solution of polyurethane elastomer and, during this wet coagulation process, the polyurethane elastomer changes the fibers into a microporous structure. In this coagulation process, these additives work as an accelerator to get more micropores and/or as a controller of the size of the pores.

In its simplest terms, the inventive method of creating indicia includes six or possibly seven steps, as shown in FIG. 2, as follows: (1) providing a game ball of the type having material over at least a portion of its exterior surface; (2) coating with a solution at lest part of the material whereat indicia is to be provided to thereby form a film; (3) contacting, with radiation, preferably a laser beam, areas of the film intended to be provided with indicia, the radiation thereby removing contacted areas of the film and modifying the exterior surface in the indicia areas and also forming a mask in the non-contacted areas of the film; (4) applying an indelible ink to the indicia areas for constituting the indicia on the surface; (5) drying the ink; and (6) removing the film. The removing is preferably effected through the peeling off of the mask film. Where necessary, the method includes the additional step of (7) washing off any unpeeled mask film. These steps can be more readily understood by a review of the schematic illustration of FIG. 2.

A more complete understanding of these method steps may be had by reference to FIGS. 3A, 3B, 3C, 3D, 3E and 3F which show in section a part of the game ball being provided with indicia by the method of the present invention. These Figures correlate generally to the steps of FIG. 2.

Figure 3A:
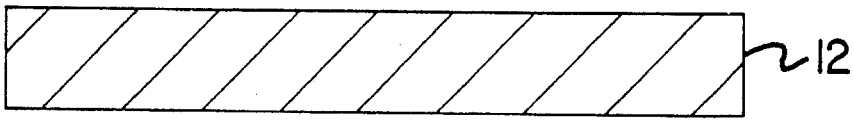
FIG. 3A, 3B, 3C, 3D, 3E and 3F are sectional views of the basketball and indicia of FIG. 1 illustrating the sequential steps in the performing of the method of the present invention.
Figure 3B:
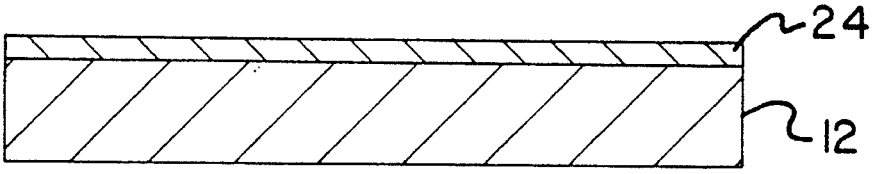
Figure 3C:
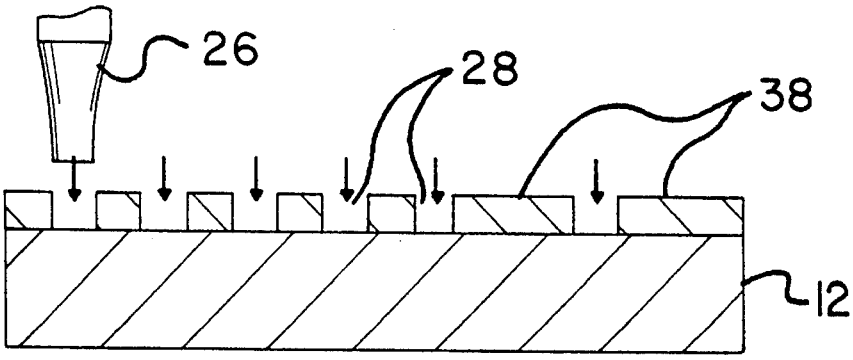
Figure 3D:
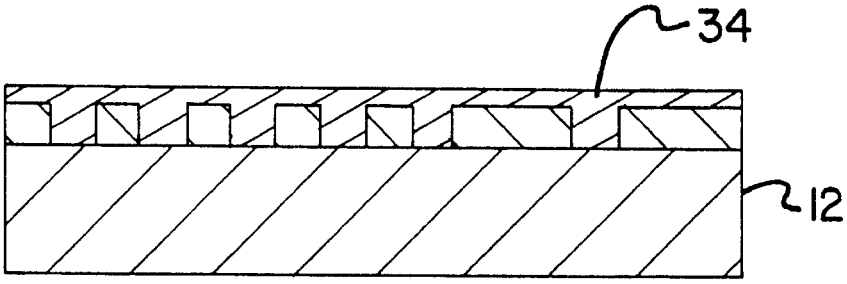
Figure 3E:
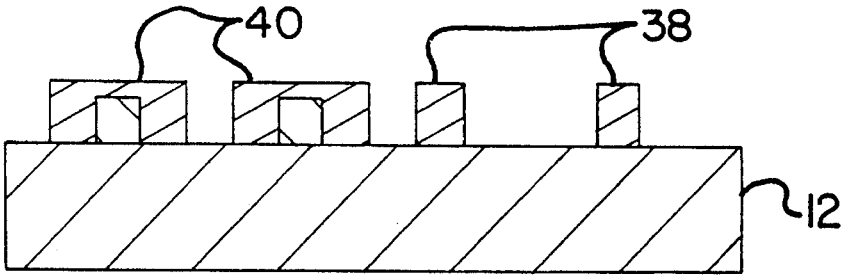
Figure 3F:
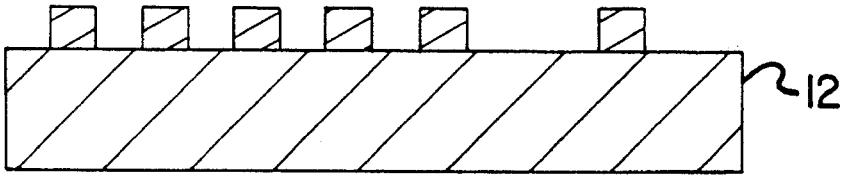

More specifically, FIG. 3A shows the exterior panel surface 12 of game ball 10 which has been provided for receiving indicia 18 in accordance with the method of the present invention. The game ball is preferably of a synthetic material as described above. The material to receive the indicia extends over at least a portion of the exterior surface. Other materials, synthetic or natural could also be utilized.

The second step involves the coating at least part of the material, at least in those areas whereat indicia is to be provided. Such coating is effected, in the preferred embodiment, with a solution of polyvinyl alcohol (PVOH) an a plasticizer and water. The three components of the composition include 9.5 parts by volume of fully hydrolyzer (99.0% to 99.87%) polyvinyl alcohol such as DuPont ELVANOL 71–30, brand polyvinyl alcohol, 7.5 parts by volume of partially hydrolyzed (87.0% to 89.0%) polyrinze alcohol such as DuPont ELVANOL 52–22, brand polyvinyl alcohol, a partially hydrolyzed PVOH, 100 part by volume, water as a solvent, and 2 parts by volume of butyl benzyl phthalate such as Monsanto SANTICIZER 160 brand softening agent, as a softener. The water is heated and the PVOH is added under agitation. When all of the PVOH is in solution, the SANTICIZER 160 brand softening agent, is added to plasticize the final film. Such coating dries to form a hardened film 24. Note FIGS. 3A and 3B. Several types of coatings, both solvent borne and water borne, may be utilized which will form a mask when dried. These coatings include solvent and water borne acrylics, solvent and water borne polyvinyl chloride (PVC) and vinyl acetate, polyvinyl acetate emulsion coatings, solvent and water borne polyurethane coatings, nitrocellulose solvent borne lacquers, and water and solvent borne alkyd coatings.

Materials which may be employed as the active ingredient include film forming fluids capable of adhering to, but not reacting with, the recipient surface, then drying into a film to protect the recipient surface therebeneath, and adapted to be ablatively removed under the influence of a laser beam. Typical of such film forming fluids are PVOH, acrylics, acetate, and polyurethane. Although such materials may be sufficient for use in the present method, it is preferred that they are used with a solvent to more readily effect its application to the recipient surface. Typical solvents include water, ethyl alcohol, butyl acetate, methyl ethyl ketone (MEK) and xylene. A plasticizer is preferably included to render the resulting film more flexible as for the peeling step. Typical plasticizers include butyl benzyl phthalate such as Monsanto SANTICIZER 160 brand softening agent, as a softener, dioctyl phthalate and a low molecular weight reactive diluent such as castor oil. Low molecular weight is intended to be about 10,000 to 30,000 number average (Mn) molecular weight and 30,000 to 50,000 weight average molecular weight (Mw). However, it has been found that the medium molecular weight polyvinyl alcohol, (Mn) is 40,000 to 70.000 and (Mw) is 115,000 to 140,000, as well as the high molecular weight polyvinyl alcohol, (Mn) is 70,000 to 90,000 and (Mw) is 170,000 to 210,000, also work well for this invention.

Next in the method of the present invention is the step of contacting the areas of the coating, now a hardened film, and the exterior surface of the game ball intended to be provided with indicia. Such contacting is done through radiation, preferably a beam from a laser 26. The laser beam is of an appropriate intensity to ablatively remove, or burning off, the film. Such action also modifies the exterior surface of the game ball in the indicia areas 28. As a result, a mask is formed in the non-indicia areas 30 of the film. Note FIG. 3C.

The fourth step is applying an ink 34 to the mask and indicia areas. Note FIG. 3D. Such ink is for constituting the indicia 16 on the surface of the game ball. The ink may be a waterborne or solvent based ink with a dye/pigment coloration system utilizing organic pigments, inorganic pigments, and/or metallic pigments and an organic binder, such as an acrylic. In the preferred embodiment, the ink is any commercially available, preferably indelible.

The ink is then dried, preferably by exposure to the ambient atmosphere. This action may be accelerated by exposure to a flow of warm air.

The next, and possibly final, step involves removing the film. Note FIG. 3E. This is effected by peeling off film 40 of the mask 30 in non-indicia areas 38. In instances where this removes all the film, the method is completed. In instances where some of the film material is separated from the mask, or in instances where film material exists in a central portion 20 of a letter naturally separated from the mask, a subsequent final step will be required. Such final step simply involves washing any unpeeled portions of the film with warm water. With all film removed, the resulting ball will have been provided with intended indicia in a safe, accurate, convenient and economical manner.

Figure 4:
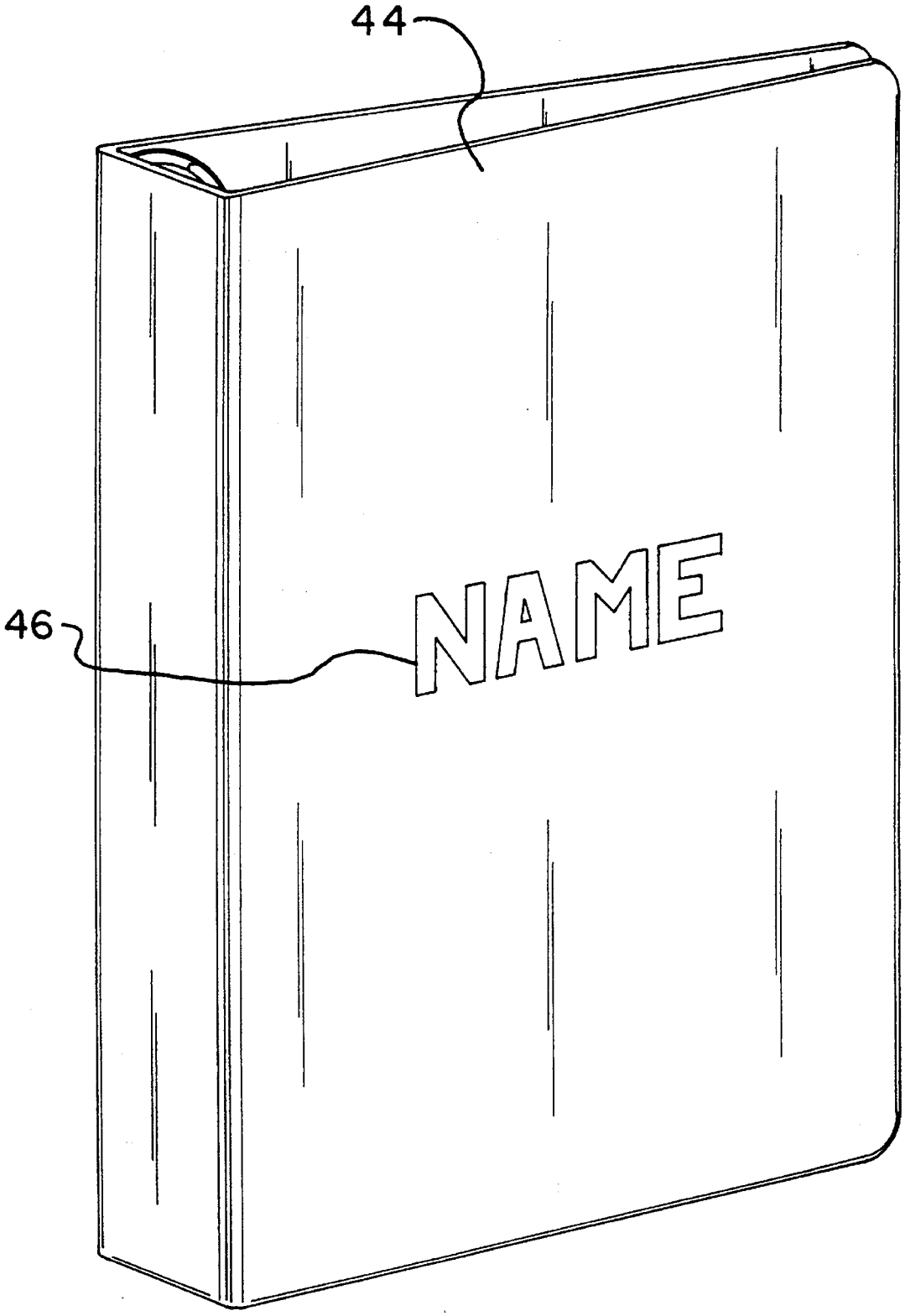
FIG. 4 is a perspective view of a binder, another article to which is applied indicia in accordance with the principles of the present invention.

The method of the present invention may be carried out on other objects and articles such as books or binders 44. Note FIG. 4. For such applications, the letters 46 forming the indicia are created by the same method steps and including the same materials as those described above with respect to the basketball 10.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A process for providing indicia to the surface of a game ball, the process comprising the steps of:

providing a game ball having a synthetic material initially forming at least a portion of its exterior surface;

coating, with a solution of polyvinyl alcohol and a plasticizer and water, at least part of the synthetic material whereat indicia is to be provided, to thereby form a hardened film;

contacting, with a laser beam, indicia areas of the hardened film and synthetic material intended to be provided with indicia, the laser beam thereby ablatively removing the film and modifying the synthetic material in the entire indicia areas and also forming a mask in the non-indicia areas of the film;

applying an indelible ink to the indicia areas for constituting the indicia on the surface of the game ball;

drying the ink;

removing the film by peeling; and washing with warm water any unpeeled portions of the film.

2. A process for providing indicia to the surface of a game ball, the process comprising the steps of:

providing a game ball having a leather material initially forming at least a portion of its exterior surface;

coating, with a solution of polyvinyl alcohol and a plasticizer and water, at least part of the leather material whereat indicia is to be provided, to thereby form a hardened film;

contacting, with a laser beam, indicia areas of the hardened film and leather material intended to be provided with indicia, the laser beam thereby ablatively removing the film and modifying the leather material in the entire indicia areas and also forming a mask in the non-indicia areas of the film;

applying an indelible ink to the indicia areas for constituting the indicia on the surface of the game ball;

drying the ink;

removing the film by peeling; and washing with warm water any unpeeled portions of the film.

3. The method as set forth in claim 2 wherein the coating is effected with a solution which includes a film forming fluid capable of adhering to a recipient surface then drying into a film to protect the recipient surface therebeneath and capable of being ablatively removed when subjected to the influence of a laser beam selected from the group consisting of polyvinyl alcohol, acrylics, polyvinyl chloride, vinyl acetate, polyvinyl acetate, and polyurethane.

4. The method as set forth in claim 3 wherein the coating is effected with a solution which includes a solvent selected from the group consisting of water, ethyl alcohol, butyl acetate, methyl ethyl ketone and xylene.

5. The method as set forth in claim 4 wherein the coating is effected with a solution which includes a plasticizer selected from the group consisting of butyl benzyl phthalate, dioctyl phthalate and a reactive dilient having a molecular weight of between about 10,000 and 210,000.

6. The method as set forth in claim 2 wherein the coating is effected with a solution of equal parts fully hydrolyzed polyvinyl alcohol and partially hydrolyzed polyvinyl alcohol in combination with water as a solvent and butyl benzyl phthalate as a plasticizer.

7. A process for providing indicia to the surface of an article, the process comprising the steps of:

providing an article having material initially forming at least a portion of its exterior surface;

coating at least part of the material whereat indicia is to be provided to thereby form a film;

contacting, with radiation from a radiation beam, indicia areas of the film intended to be provided with indicia, the radiation thereby removing the film and modifying the surface of the material of the indicia areas and also forming a mask in the non-indicia areas of the film;

applying an ink to the indicia areas thereby forming the indicia on the surface;

drying the ink; and removing the film.

8. The method as set forth in claim 7 wherein the coating is effected with a solution of polyvinyl alcohol, a plasticizer and water.

9. The method as set forth in claim 7 wherein the coating is effected with a solvent borne solution.

10. The method as set forth in claim 7 wherein the coating is effected with a water borne solution.

11. The method as set forth in claim 7 wherein the radiation is a laser beam.

* * * * *